US009259037B2

(12) United States Patent
Woods

(10) Patent No.: US 9,259,037 B2
(45) **Date of Patent: *Feb. 16, 2016**

(54) BRA

(71) Applicant: Nadine Woods, Toronto (CA)

(72) Inventor: Nadine Woods, Toronto (CA)

(73) Assignee: Nadine Woods, Toronto, Ontario (CA)

( * ) Notice: Subject to any disclaimer, the term of this patent is extended or adjusted under 35 U.S.C. 154(b) by 0 days.

This patent is subject to a terminal disclaimer.

(21) Appl. No.: 14/398,920

(22) PCT Filed: Jan. 28, 2014

(86) PCT No.: PCT/CA2014/000057

§ 371 (c)(1),
(2) Date: Nov. 4, 2014

(87) PCT Pub. No.: WO2014/113881

PCT Pub. Date: Jul. 31, 2014

(65) Prior Publication Data

US 2015/0087202 A1 Mar. 26, 2015

Related U.S. Application Data

(63) Continuation of application No. 14/069,896, filed on Nov. 1, 2013, now Pat. No. 8,758,082.

(60) Provisional application No. 61/757,397, filed on Jan. 28, 2013.

(51) Int. Cl.
*A41C 3/04* (2006.01)
*A41C 3/00* (2006.01)

(52) U.S. Cl.
CPC *A41C 3/04* (2013.01); *A41C 3/0028* (2013.01)

(58) Field of Classification Search
CPC ..... A41C 3/00
USPC ..... 450/1, 57, 58, 36, 59, 24, 86, 87
See application file for complete search history.

(56) References Cited

U.S. PATENT DOCUMENTS

| | | | |
|---|---|---|---|
| 3,439,682 | A | 4/1969 | Defru |
| 3,773,052 | A | 11/1973 | Belardinelli |
| 4,355,641 | A | 10/1982 | Dastoli |
| 4,423,734 | A | 1/1984 | Schawel |
| 4,550,734 | A | 11/1985 | Porco |
| 4,633,876 | A | 1/1987 | Scullin |
| 6,878,033 | B2 | 4/2005 | Luk |
| 6,896,581 | B2 | 5/2005 | Otto |

(Continued)

OTHER PUBLICATIONS

PCT/CA2014/000057, International Search Report, May 26, 2014.

*Primary Examiner* — Gloria Hale
(74) *Attorney, Agent, or Firm* — Millman IP Inc.

(57) ABSTRACT

In one aspect a bra is provided, and includes a pair of cups that are self-supporting, a strap connected to each cup, a bridge connecting the inboard ends of each cup, and a band extending from the outboard end of each cup and configured to extend around the back of a wearer of the bra. Each cup is foldable along a fold line between an unfolded position wherein the cup covers a nipple of the wearer and a folded position wherein the cup exposes the nipple of the wearer, wherein, when the bra is worn by the wearer, each cup is stable in both the unfolded position and the folded position. In another embodiment a bra is provided with cups that are stable in both the folded and unfolded positions wherein the cups are not self supporting.

20 Claims, 11 Drawing Sheets

(56) References Cited

U.S. PATENT DOCUMENTS

| | | | | |
|---|---|---|---|---|
| 6,918,812 | B2 | 7/2005 | Giese | |
| 7,234,993 | B2 | 6/2007 | Lin | |
| 7,244,167 | B2 | 7/2007 | Falla | |
| 7,435,156 | B1 | 10/2008 | Liu | |
| 7,556,553 | B2 | 7/2009 | Falla et al. | |
| 7,666,059 | B2 | 2/2010 | Falla et al. | |
| 7,722,432 | B2 | 5/2010 | Wood et al. | |
| 8,262,434 | B2 | 9/2012 | Falla et al. | |
| 8,277,276 | B2 | 10/2012 | Waitz et al. | |
| 8,758,082 | B1 * | 6/2014 | Woods | 450/86 |
| 2004/0016039 | A1 | 1/2004 | Caprio | |
| 2011/0237157 | A1 | 9/2011 | Scott et al. | |

* cited by examiner

BRA

This application claims priority to U.S. Provisional Patent Application No. 61/757,397 filed Jan. 28, 2013, and U.S. patent application Ser. No. 14/069,896 filed Nov. 1, 2013 the contents of which are incorporated herein in their entirety.

FIELD

This disclosure relates generally to bras and more particularly to nursing bras.

BACKGROUND

A nursing bra can greatly facilitate the nursing of an infant while providing support for the mother's breasts when not nursing the infant. However, some nursing bras suffer from several problems. One problem is that some nursing bras cover a large portion of the chest and neck area of the wearer. This can greatly reduce the options available for the wearer in terms of blouses or the like that can be worn without having part of the bra exposed. Another problem is that some such bras traditionally have cups that hinge open and closed and that clip to the straps to hold the cups in the 'closed' position. Such bras can have relatively wide shoulder straps, and can also have an upperbust panel that extends between the shoulder strap and the bridge and passes over the top of the breast of the wearer. These upperbust panels can be uncomfortable for the wearer however, and can increase the profile of the bra thereby making it more difficult to wear blouses that are lower-cut without exposing the bra. Yet another problem with such bras is that the clips can in some instances be difficult to operate with a single hand. Furthermore the presence of the clip can detract from the appearance of the bra. In addition to these aforementioned problems, the cups of such bras typically expose the entire breast of the wearer when not clipped in the closed position. Thus, the wearer may wind up exposing more of their breast then they would otherwise desire, while nursing their infant.

It would be advantageous to provide a bra that partially mitigates one or more of the above-noted problems, and other problems.

SUMMARY

According to one aspect a bra is provided, and includes a pair of cups that are self-supporting, a strap connected to each cup, a bridge connecting the inboard ends of each cup, and a band extending from the outboard end of each cup and configured to extend around the back of a wearer of the bra. When the bra is worn by the wearer, each cup is foldable along a fold line between an unfolded position wherein the cup covers a nipple of the wearer and a folded position wherein the cup exposes the nipple of the wearer, wherein, when the bra is worn by the wearer, each cup is stable in both the unfolded position and the folded position.

In yet another aspect, a bra is provided, and includes a pair of cups that are not self-supporting, a contiguous band including a front portion and a rear portion, wherein the front portion supports the cups and the rear portion extends around the back of a wearer of the bra, and a strap connected to an inboard upper portion of each cup. The inboard upper portion extends from the strap past a vertical centerline of the bra and connects to the band, wherein the inboard upper portion of each cup is unconnected to the inboard upper portion of the other cup. When the bra is worn by the wearer, each cup is foldable between an unfolded position wherein the cup covers a nipple of the wearer and a folded position wherein the cup exposes the nipple of the wearer. When the bra is worn by the wearer each cup is stable in both the unfolded position and the folded position.

BRIEF DESCRIPTION OF DRAWINGS

The foregoing and other aspects will be more readily appreciated by reference to the accompanying drawings, wherein.

DETAILED DESCRIPTION

Figure 1:
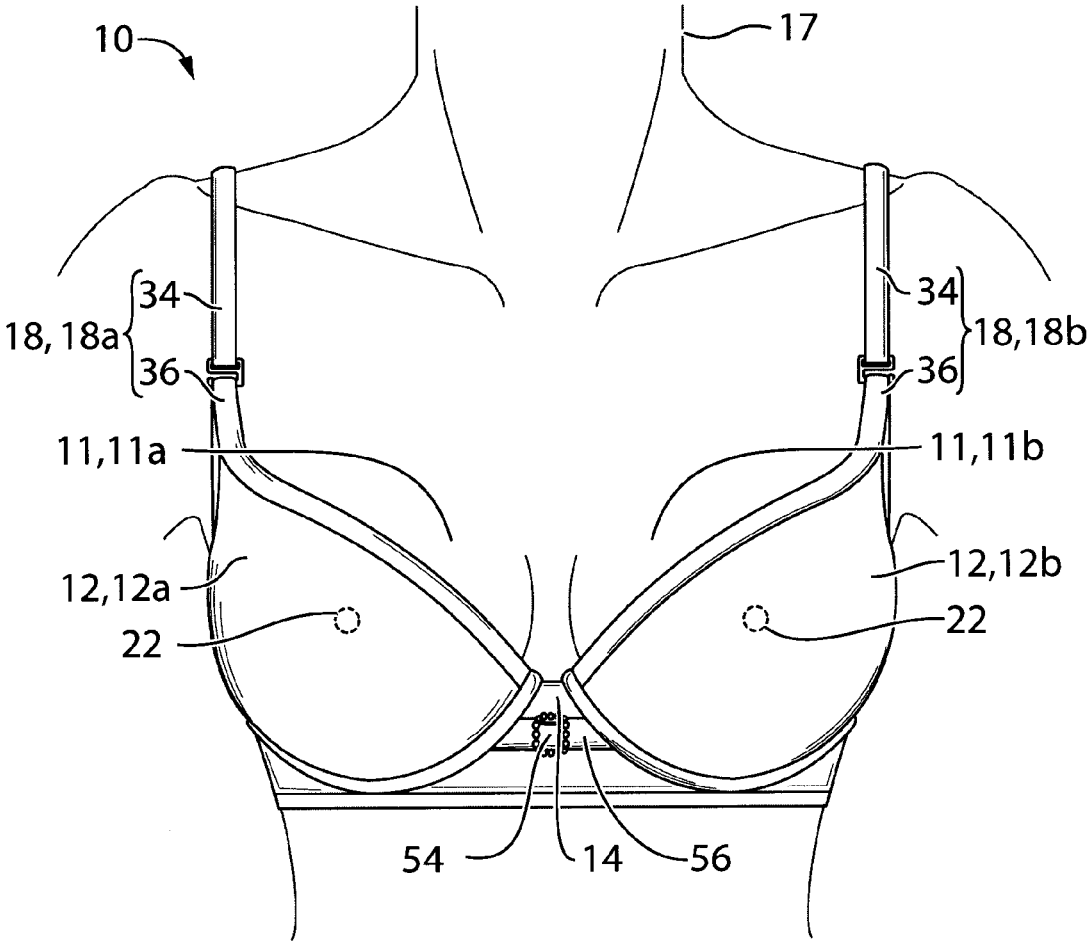
FIG. 1 is a front elevation view of an embodiment of a bra.

Reference is made to FIG. 1, which shows a bra 10. The bra 10 may be referred to herein as a nursing bra, however, it will be understood that it may be used in circumstances other than for nursing. The nursing bra 10 supports the breasts 11 (shown individually at 11*a* and 11*b*) of a wearer 17, while having a relatively low profile (in some embodiments at least) so as to permit greater freedom of selection of clothing by the wearer 17. Additionally, the bra 10 can easily be folded as needed with one hand by the wearer 17 to expose the nipples (shown at 22) of the wearer 17 for the purpose of nursing an infant. The bra 10 includes first and second cups 12 (shown individually at 12*a* and 12*b*), a bridge 14 between the cups, a band 15 (FIG. 2) that extends from the cups 12 around the back (shown at 16) of a wearer 17 (and which may include a releasable closure 19 made up of, for example, a plurality of hooks and eyes as is known in the art). The bra 10 further includes first and second straps 18 (shown individually at 18*a* and 18*b*). In at least some figures the wearer 17 is represented by a torso of a mannequin.

Figure 2:
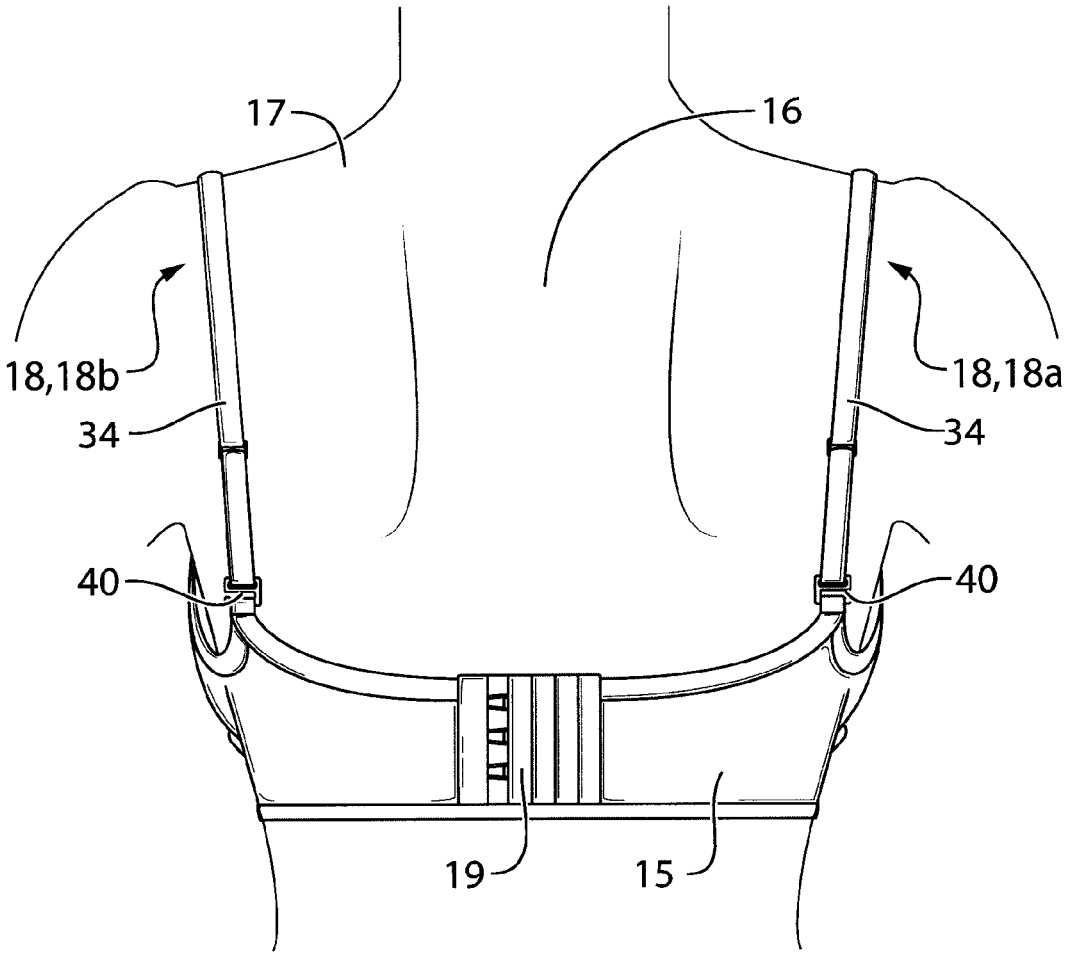
FIG. 2 is a rear elevation view of the bra shown in FIG. 1.
Figure 3:
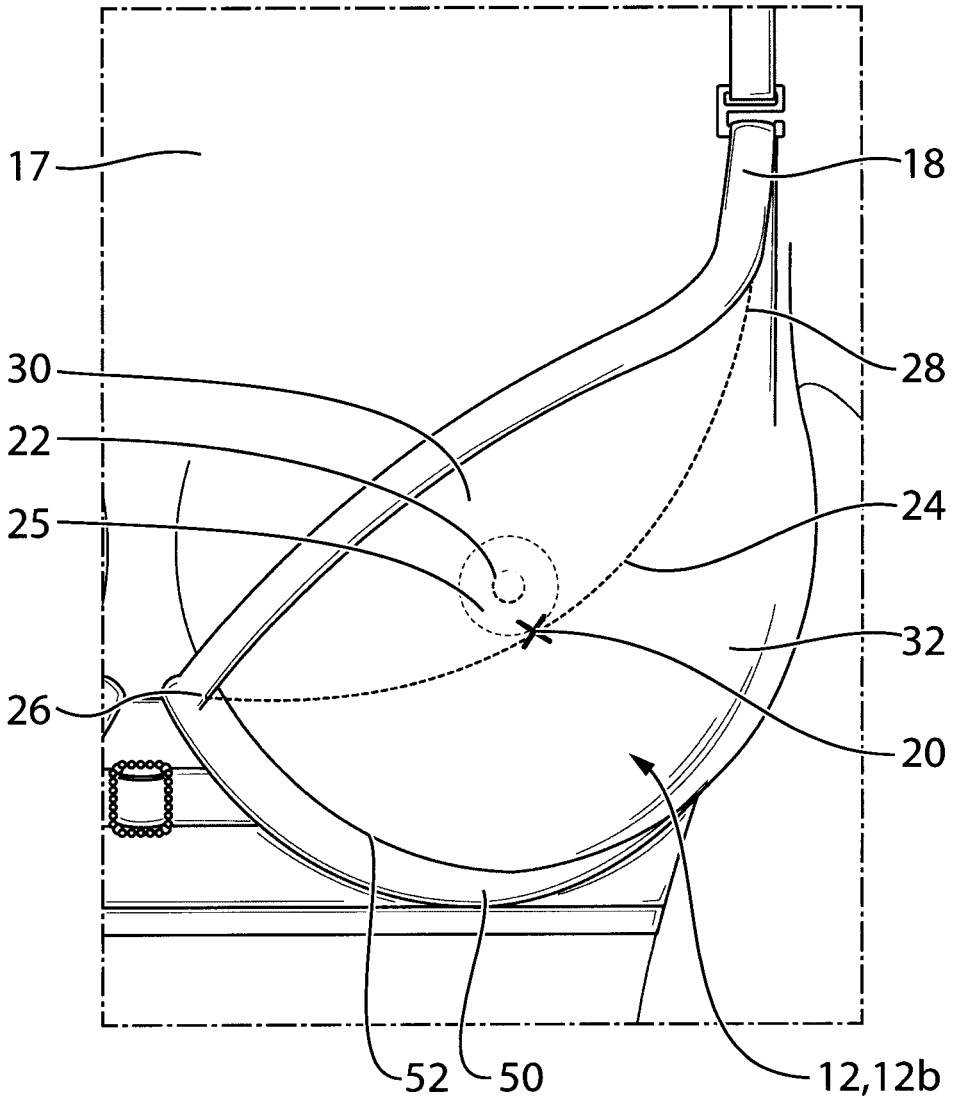
FIG. 3 is a magnified front elevation view of one of the cups of the nursing bra shown in FIG. 1.

One of the cups 12 (cup 12*b*) is shown enlarged in FIG. 3. Each cup 12 includes an apex 20, which may be a point on the cup 12 that corresponds generally to the position of the nipple 22 of the wearer 17, or which, in some embodiments, may be a point on the cup 12 that is offset from the nipple 22 of the wearer 17. In the embodiment shown in FIG. 3, the apex 20 is below the nipple 22. The cup 12 in the embodiment shown in FIGS. 1-6 is self supporting, in the sense that it generally retains its shape without external support. This may be provided by any suitable means, such as by a molded element that forms part of the cup 12. The molded element may be made from, for example, a polymeric foam material such as polyester with some rubber content, or a polyurethane foam. The molded element may be covered on its inner and outer surfaces with suitable materials, such as a cotton layer on the interior and a polyester layer on the outer surface.

The cup 12 is foldable along a fold line shown at 24, between an unfolded position (FIGS. 1 and 3) wherein the cup 12 covers the nipple 22 of the wearer 17 and a folded position (FIGS. 5 and 6) wherein the cup 12 exposes the nipple 22 of the wearer 17. When the nursing bra 10 is worn by the wearer 17. The bra 10 is configured to cooperate with the body of the wearer 17 such that the cup 12 stable in both the unfolded position and the folded position. In a preferred embodiment, the cup 12, when in the folded position exposes the entire areola of the wearer 17, represented at 25.

The fold line 24 has an inboard end 26 and an outboard end 28 that is higher than the inboard end 26 so that the fold line 24 extends generally diagonally along the cup 12. The fold line 24 thus divides the cup 12 into an upper, inboard portion 30, and a lower, outboard portion 32. The inboard end 26 of the fold line 24 may correspond to the point at which the bridge 14 joins to the cup 12. The outboard end 28 of the fold line 24 is discussed further below. In the embodiment shown, the cup 12 is configured so that the apex 20 is proximate the fold line 24, however, other positions for the apex 20 relative to the fold line 24 are possible.

The stability of the cup 12 in the unfolded position may be provided in part by the structure of the cup 12 itself (i.e. the resiliency of the molded element that forms part of the cup 12). Additionally, the stability of the cup 12 in the unfolded position may be provided by the associated strap 18. More particularly, the strap 18 includes a primary portion 34 and an end portion 36. The primary portion 34 connects at a first end 38 to the end portion 36 and extends upwardly from the first end over the shoulder of the wearer 17 and downwardly to connect at a second end 40 to the band 15. In some embodiments, (as shown in FIG. 2), the straps 18 may simply extend directly downwardly such that the right strap 18*a* (taken from the wearer's point of view) connects to the band 15 on the right side of the wearer's back 16 and the left strap 18*b* connects to the band 15 on the left side of the wearer's back 16. In some embodiments the straps 18*a* and 18*b* may cross each other in the back before connecting to the band 15 so that the right strap 18*a* connects to the band 15 on the left side of the wearer's back 16 and vice versa. The straps 18 may be removable from the band 15 at their second ends 40. In some embodiment the primary portions 34 of the straps 18 may be removable at their respective first ends 38 and second ends 40. The wearer 17 could, in such a case, wear the bra 10 in a halter configuration, whereby the wearer 17 connects the first end 38 of one primary portion 34 to the end portion 36 on the right side of the wearer 17, runs the length of that primary portion 34 around the back of her neck, and connects the second end 40 of that primary portion 34 to the end portion 36 on the left side of the wearer 17. In such a case, the bra 10 may still be considered to have two straps 18 each including a primary portion 34 and a secondary portion 36, except that the primary portions 34 would be considered to be integrally connected together around the back of the neck of the wearer 17 instead of being connected to the band 15.

Figure 4:
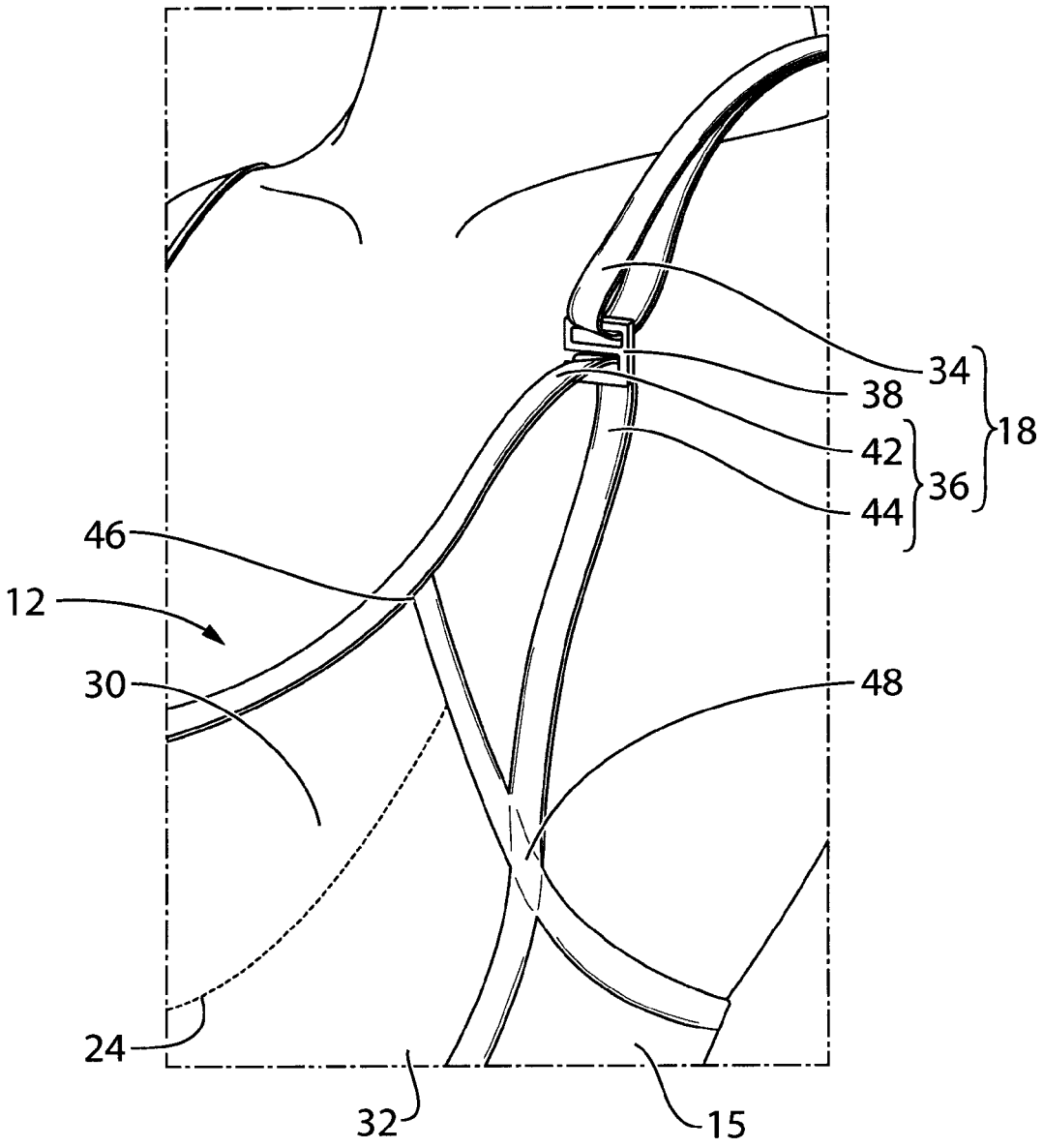
FIG. 4 is a magnified front elevation view of a connection between a strap and one of the cups of the nursing bra shown in FIG. 1.
Figure 5:
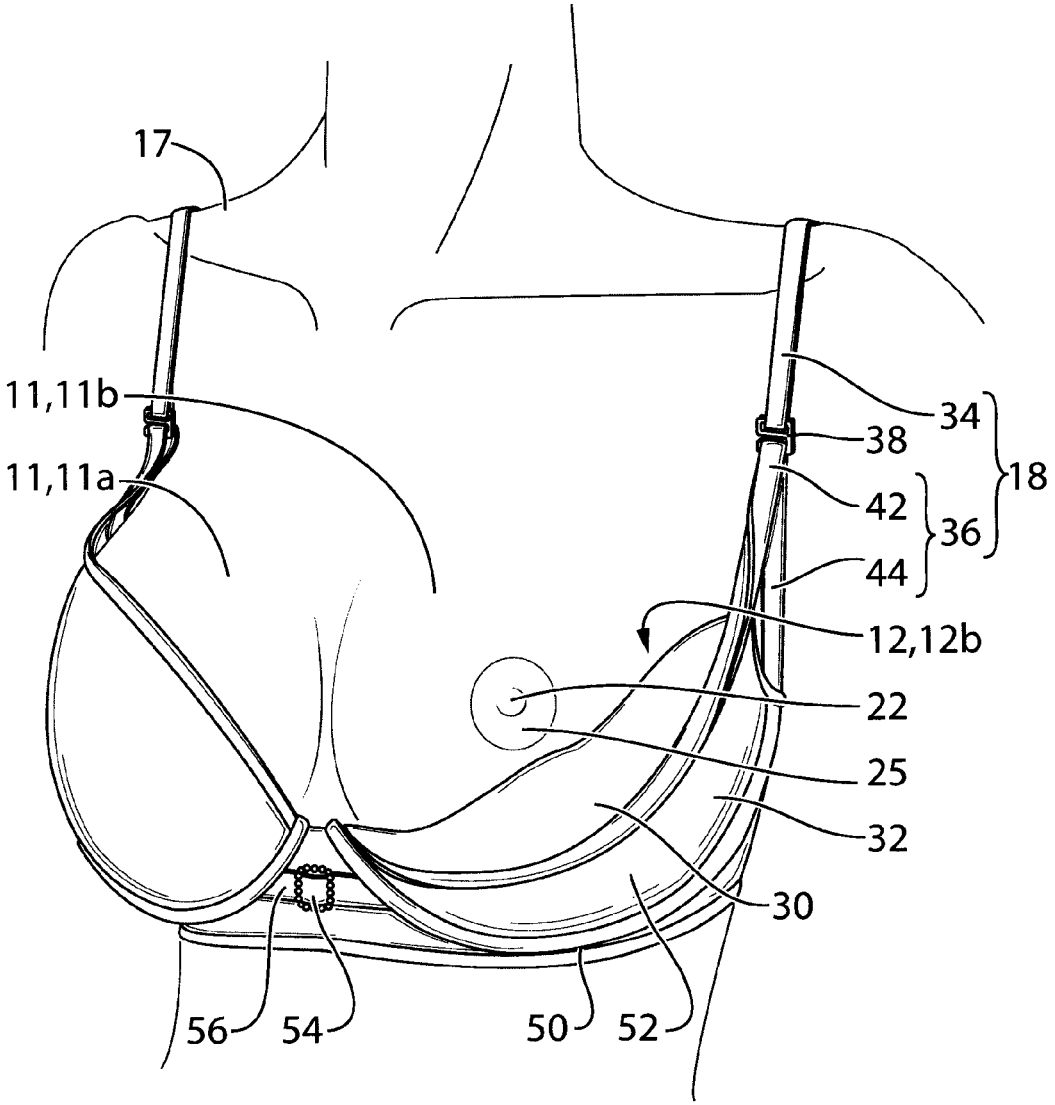
FIG. 5 is a perspective view of the bra shown in FIG. 1 with one of the cups shown in a folded position.
Figure 6:
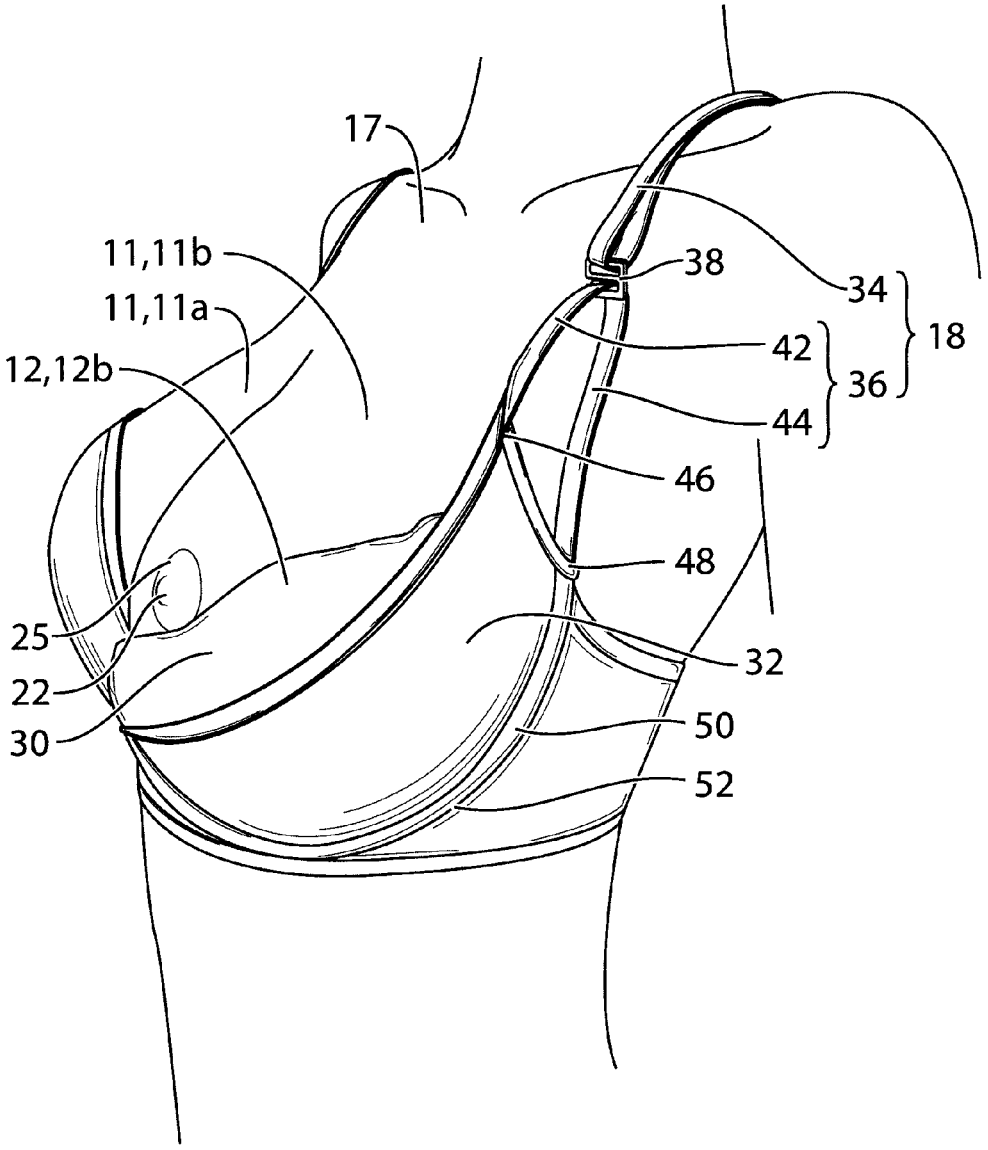
FIG. 6 is another perspective view of the bra with one of the cups shown in the folded position.

Referring to FIG. 4 the end portion 36 may include an inboard end portion 42 that connects to the upper, inboard cup portion 30 and an outboard end portion 44 that connects to one or both of the lower, outboard portion 32 and the band 15. The inboard end portion 42 may be elastically stretchable and may be positioned to exert a biasing force on the upper, inboard portion 30 of the cup 12 to hold the upper, inboard portion 30 in an unfolded position relative to the lower, outboard portion 32 when the cup 12 is in the unfolded position during use (FIGS. 1 and 3) and to exert a biasing force on the upper, inboard portion 30 to hold the upper, inboard portion 30 in a folded position relative to the lower, outboard portion 32 when the cup 12 is in the folded position during use (FIGS. 5 and 6). More specifically, the inboard end portion 42 connects to the cup 12 at a connection point 46 and is in tension when the cup 12 is in the unfolded position and when the cup 12 is in the folded position.

When the cup 12 is in the unfolded position the tension in the inboard end portion 42 exerts an upward force on the cup 12 which urges the cup 12 upwardly, slightly dorsally and slightly laterally outwardly, thereby resulting in a biasing force that urges the cup 12 to remain in the unfolded position. In a preferred embodiment, the connection point 46 is in the upper, inboard portion 30 of the cup 12 so that the inboard end portion 42 urges the upper, inboard portion 30 upwardly and thus urges the portion 30 to remain unfolded relative to the lower, outboard portion. As can be seen the connection portion may be uppermost point on the cup 12, which reduces or eliminates 'dead zones' in the cup 12 which are regions of the cup 12 which do not receive a component of the tensile force in the inboard end portion 42.

When the cup 12 is in the folded position (FIGS. 5 and 6), such that the upper, inboard portion 30 is folded over and engages the lower, outboard portion 32. While there may be some restoring force that exists in the cup 12 urging the upper, inboard portion 30 to rotate forward and up back to its unfolded position, the tension in the inboard end portion 42 results in a biasing force that urges the point 46 on the cup 12 upwardly, slightly dorsally, and slightly laterally outwardly. The upward and dorsal components of the force exerted on the point 46 drive the folded upper, inboard portion 30 of the cup 12 into stronger engagement with the lower, outboard portion 32 (and into the bottom of the breast 11 of the wearer 17), thereby preventing the restoring force from moving the point 46 forwardly, which in turn prevents the upper, inboard portion 30 from rotating as needed to return itself to the unfolded position. As a result, the cup 12 remains in the folded position.

The outboard end portion 44 may be non-stretchable. The end portion 36 may be a contiguous strip of material to which the primary portion 34 is slidably connected, as shown in FIG. 4. As a result, the portion of the strip of material that makes up the inboard end portion 42 and the portion that makes up the outboard end portion 44 can vary during use of the bra 10. Furthermore, it will be noted that the entirety of the inboard end portion 42 need not be made from a stretchable material in order for the inboard end portion 42 to be stretchable. It would suffice for a portion of the length of the inboard end portion 42 to be made from a stretchable material. An example of a suitable elastic material for the inboard end portion 42 is nylon and spandex. The particular amounts of nylon and spandex used may be, for example, about 85% nylon and about 15% spandex.

The connection point of the outboard end portion 44 with one or both of the lower, outboard portion 32 and the band 15 is shown at 48. The connection points 46 and 48 at least roughly define the position of the outboard end 28 of the fold line 24. When the cup 12 is folded to the folded position, the inboard and outboard end portions 42 and 44 may become generally aligned with one another, and as such, the outboard end 28 of the fold line 24 was thus at a point that is centered between them (when the cup 12 is in the unfolded position). It will be noted that the position of the end 38 of the primary portion 34 of the strap 18 may also be substantially centered along the end portion 36 and may be substantially centered between the connection points 46 and 48. Thus the outboard end 28 of the fold line 24 may be substantially aligned vertically with the end 38 of the primary portion 34 of the strap 18. In other words, the end 38 of the primary portion 34 of the strap 18 may be approximately at the same position laterally as the outboard end 28 of the fold line 24. It will be noted that the outboard end 28 need not be perfectly aligned vertically with the end 38 of the primary portion 34 of the strap 18. For example, in an embodiment the outboard end of the fold line 24 may be 1 inch or even 1.5 inches outboard of the end 38 of the primary portion 34 of the strap 18. In a more preferred embodiment the outboard end of the fold line 24 may be 0.75 inches outboard of the end 38 of the primary portion 34 of the strap 18. In a more preferred embodiment the outboard end of the fold line 24 may be 0.5 inches outboard of the end 38 of the primary portion 34 of the strap 18. The more the outboard end 28 of the fold line 24 moves outboard of the end 38 of the primary portion 34 of the strap 18, the more the end portion 36 of the strap 18 will urge the primary portion 34 of the strap 18 to move outwards laterally and thereby urge the primary portion 34 towards dropping off the shoulder of the wearer.

It will further be noted that the connection point 46, while inboard of the fold line 24, remains proximate the fold line 24 and is outboard (and preferably well outboard) of the apex 20 of the cup 12. In an embodiment, the connection point 46 may be within about an inch from the fold line 24. This placement of the connection point 46 and the lack of a hooked bra cup panel that is used on typical nursing bras facilitates fashioning the bra 10 in a style not traditionally associated with nursing bras. For example, the cups 12 of the bra 10 may be demi-cups or balcony cups, which typically have straps that are set far apart (i.e. they are set relatively far outboard), and which typically have a at least a somewhat plunging neckline, thereby permitting the bra to be worn with clothing that has a wide neckline and/or a low neckline. By contrast, a typical nursing bra substantially covers the entirety of the wearer's breasts, has cups in which the inboard edges are relatively close to the wearer's medial axis, has a relatively high neckline, and has straps that are relatively far inboard, so as to position the eyes for receiving the hooks on the bra cup panels. Thus, a typical nursing bra cannot be worn with clothing having a wide neckline or a low neckline without exposing the straps and/or the cups of the bra. It can be seen that the mechanisms described herein can be used on a wide array of bra and cup styles that eliminate the need for the wearer to change their style of clothing when nursing.

It will be noted that, due to the substantial alignment vertically of the end 38 of the primary portion 34 of the strap 18 and of the outboard end 28 of the fold line 24, and due to the relative proximity between the connection points 46 and 48 to the outboard end 28 of the fold line 24, the strap 18 remains substantially stationary laterally when the cup 12 is folded to the folded position. As a result, the strap 18 is relatively unlikely to fall off the shoulder of the wearer 17 when the cup 12 is folded. By contrast, with some proposed bras of the prior art, the strap moves laterally outwardly by a significant distance, thereby increasing the risk that the strap will fall of the wearer's shoulder, and even if it does not fall off, it may contribute to discomfort by the wearer when the bra is in a position for nursing.

An underwire 50 may be provided as shown in FIG. 3. The underwire 50 extends along a peripheral edge 52 of the lower, outboard portion 32 of each cup 12 and helps to support the cup 12 in the unfolded position and in the folded position. In some embodiments, the underwire 50 may define one or both of the first and second ends 26 and 28 of the fold line 24. In the embodiment shown, a first end of the underwire 50 ends at approximately the same point that the bridge 14 joins to the cup 12, and so one or both of the bridge 14 and the underwire 50 may be said to define the inboard end 26 of the fold line 24.

Optionally, as shown in FIG. 5, a breast use indicator 54 may be provided on the bra 10. The breast use indicator 54 is an indicator that can be used to identify which breast 11 was most recently used to nurse the infant. During breastfeeding, it can be advantageous to ensure that the mother alternates which breast the infant feeds from, so as to ensure that both breasts produce milk equally. When it is time to nurse the infant, however, it can occur that the mother will forget which breast was last used in the previous feeding. Providing the indicator can remind her which one was last used so that she can know which breast to start with during the current feeding.

In the example shown, the indicator 54 may be movable between a first position wherein it is proximate the right breast 11*a* and a second position wherein it is proximate the left breast 11*b*. The indicator 54 may be slidable along an indicator band 56. In some embodiments, the indicator 54 and the band 56 may be ornamentally consistent with the rest of the bra 10 so that they can appear as an embellishment on the bra 10 when not being used to indicate recent breast usage.

In the embodiment shown, the breast use indicator 54 and the band 56 are on the bridge 14, however, they may be positioned anywhere that is suitable on the bra 10.

Figure 7:
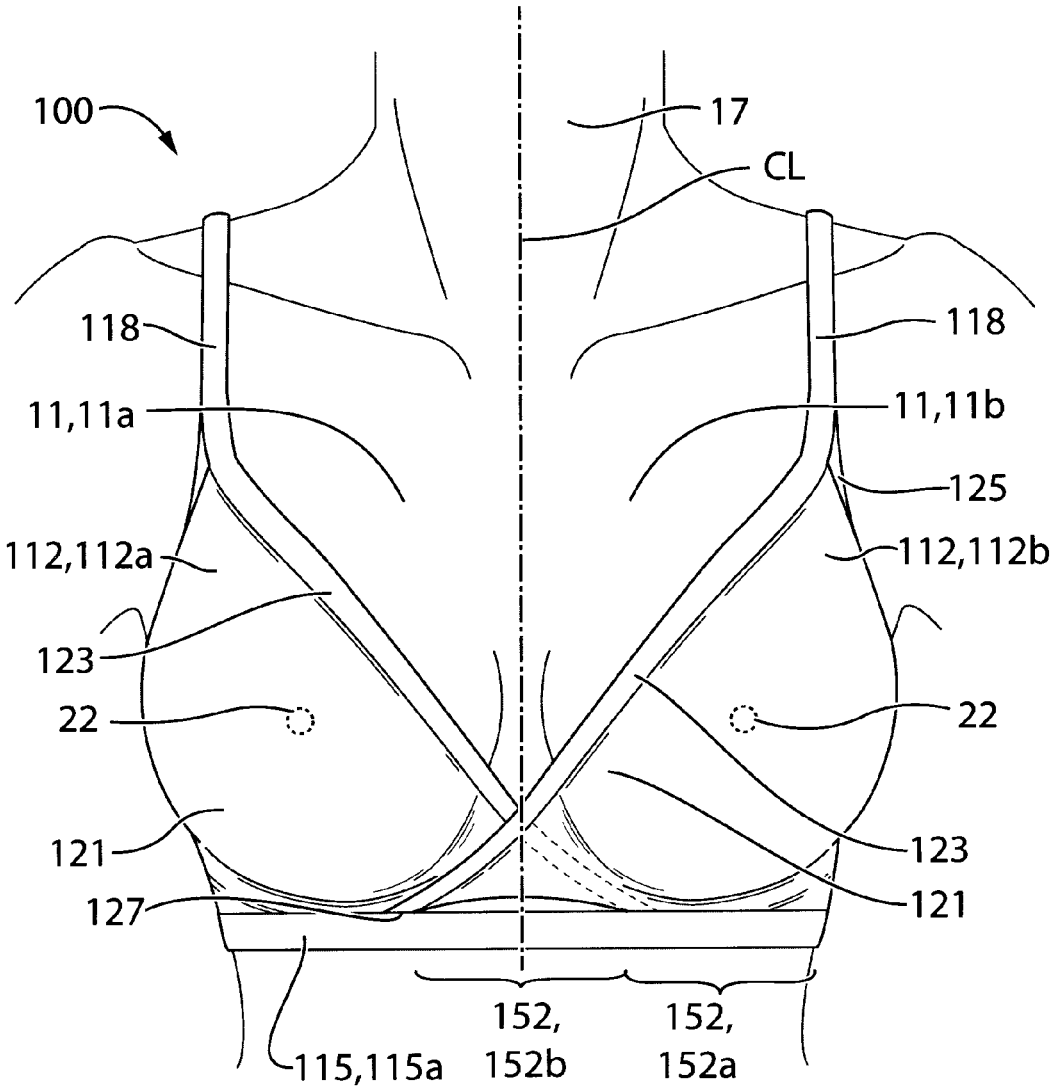
FIG. 7 is a front elevation view of another embodiment of a bra.
Figure 8:
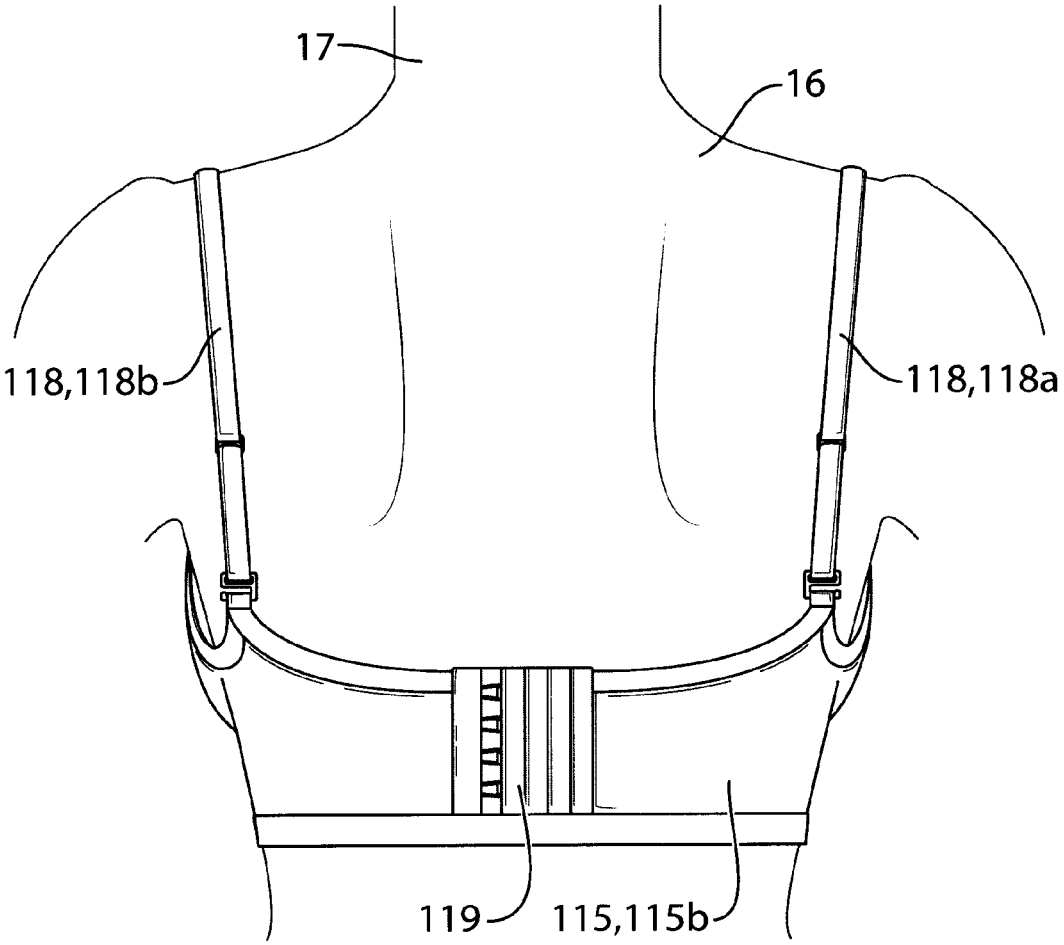
FIG. 8 is a rear elevation view of the bra shown in FIG. 7.

Reference is made to FIG. 7, which shows another embodiment of a bra shown at 100. The bra 100 may differ from the bra 10 in that the bra 100 may have cups shown at 112 that are not self-supporting, and which are shown individually at 112*a* and 112*b*. The bra 100 further includes a band 115 that is contiguous and that includes a front portion 115*a*, and a rear portion 115*b* (FIG. 8). The front portion 115*a* (FIG. 7) supports the cups 112. The rear portion 115*b* (FIG. 8) extends around the back 16 of the wearer 17, and may include a releasable closure shown at 119.

Straps 118 (shown individually 118*a* and 118*b*) are connected to an upper portion of each cup, which includes an inboard upper portion 121 and an outboard upper portion 125. For each cup 112, the inboard upper portion 121 extends from the strap 118 past a vertical centerline of the bra 100 (shown at CL in FIG. 7), and connects to the band 115. In the embodiment shown in FIG. 7 the inboard upper portion 121 connects to the band 115 at connection point 127 which is on the opposite side of the centerline CL to where the inboard upper portion 121 connects to the strap 118. In an alternative embodiment shown in FIG. 9, the inboard upper portion 121 wraps approximately 180 degrees around the inboard upper portion of the other cup thereby crossing the centerline CL from one side of the centerline CL to the other side of the centerline CL and then crossing back over to the one side of the centerline CL to connect to the band 115 on the same side of the centerline CL where the inboard upper portion 121 connects to the strap 118.

Figure 9:
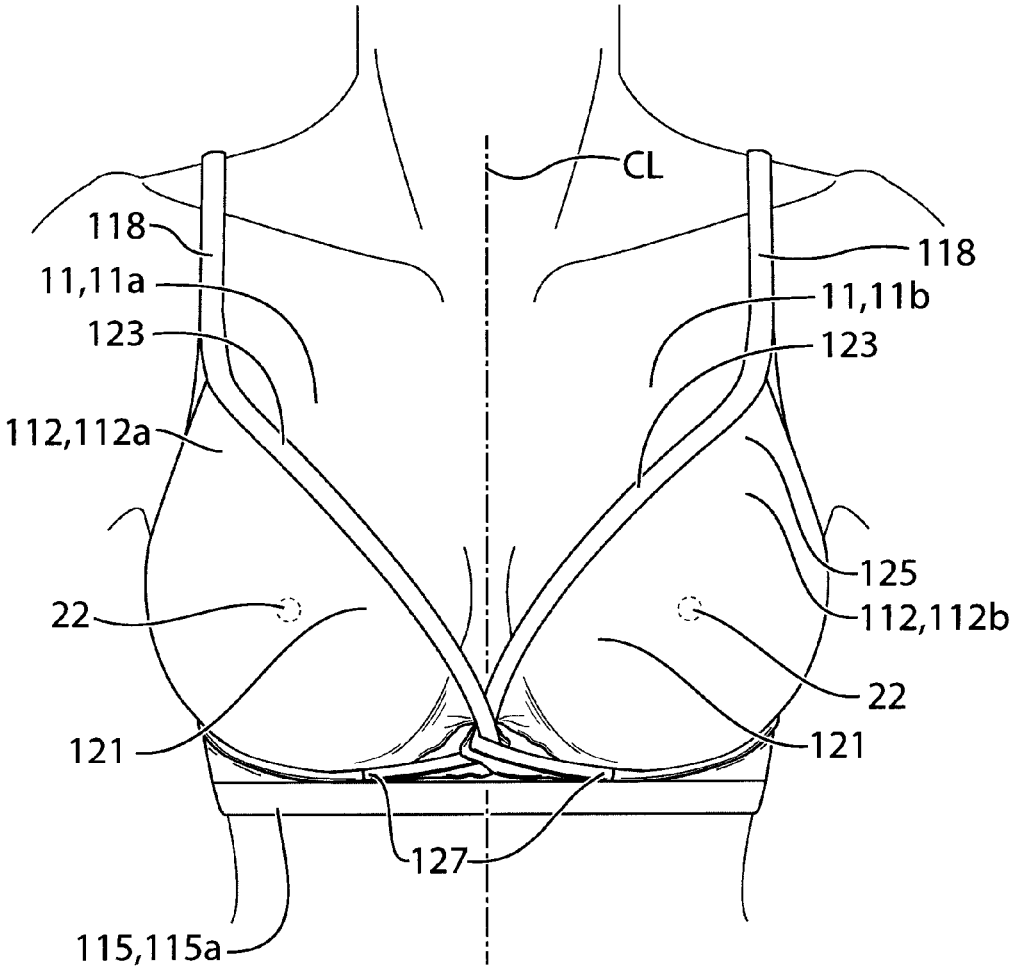
FIG. 9 is a front elevation view of a variant of the bra shown in FIG. 7.

It will be noted that, for both the embodiments shown in FIGS. 7 and 9, the inboard upper portion 121 on one side of the bra 100 is unconnected to the inboard upper portion 121 on the other side of the bra 100. As a result, the inboard upper portion 121 on one side of the bra 100 can be folded down from the unfolded position shown in FIG. 7 to a folded position shown in FIGS. 10 and 11 while having relatively little impact on the cup 112 on the other side of the bra 100. In both the embodiments shown in FIGS. 7 and 9, the entirety of the cup 112*a* is unconnected with the entirety of the cup 112*b*.

Figure 10:
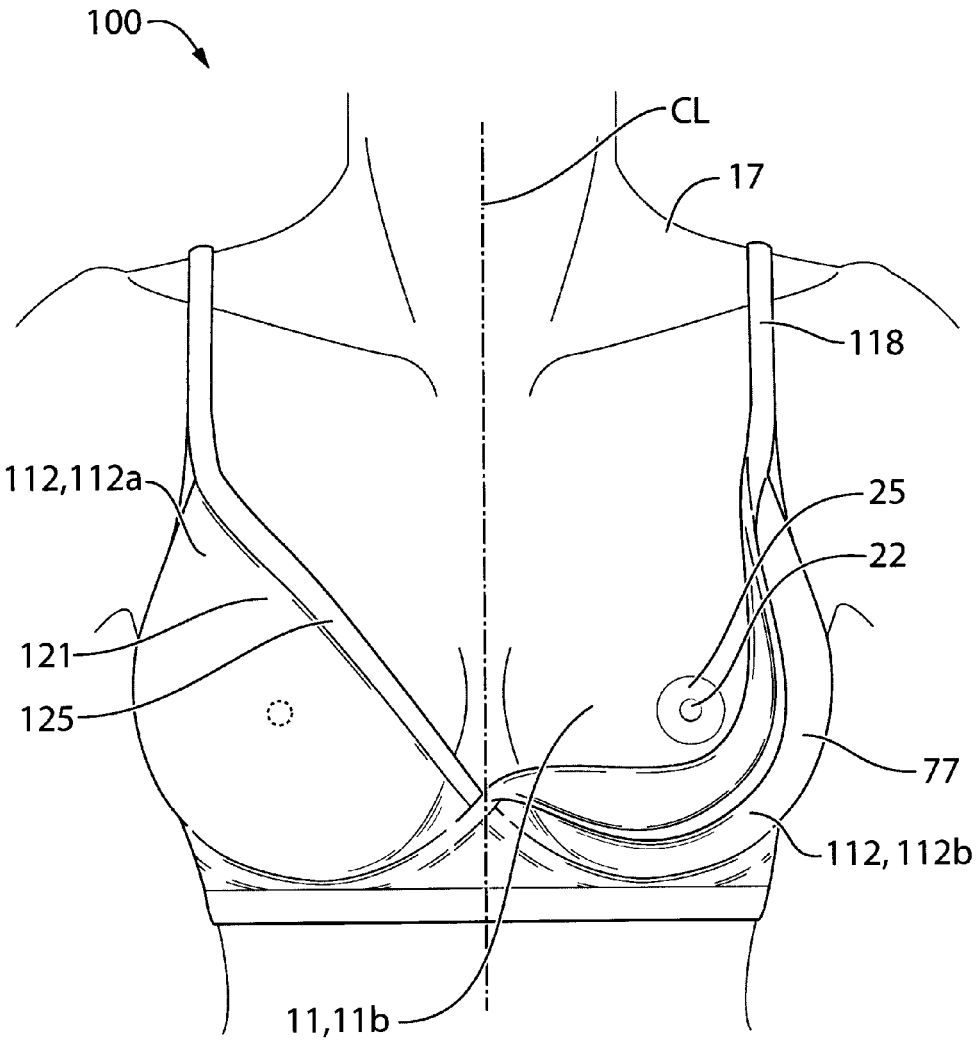
FIG. 10 is a front elevation view of the bra shown in FIG. 7 in a folded position.
Figure 11:
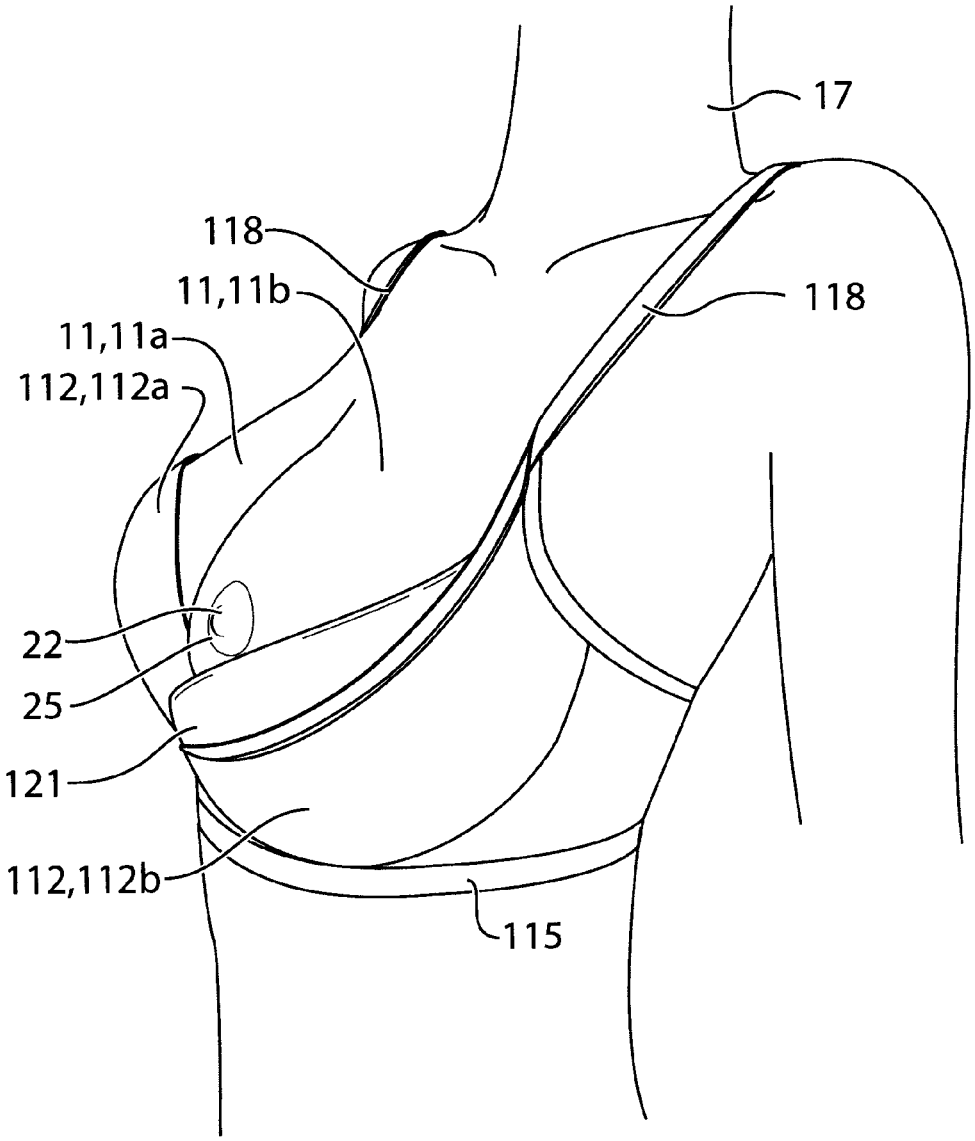
FIG. 11 is a perspective view of the bra shown in FIG. 7 in the folded position.

The inboard upper portion 121 of each cup 112 may be elastically stretchable. In the embodiment shown the inboard upper portion 121 includes an inboard edge member 123 that is elastically stretchable. Additionally or alternatively, the strap 118 is elastically stretchable. When the cup 112 is brought from the unfolded position shown in FIG. 7 to the folded position shown in FIGS. 10 and 11, tension exists in the strap 118 and the inboard upper portion 121 which exerts a force on the cup 112 in an upward and slightly dorsal direction. This force keeps the cup 112 in the folded position against the underside of the breast 11 as shown in FIGS. 10 and 11. As a result, the cup 112 is stable in the folded position. When the cup 112 is in the unfolded position tension in the strap 118 and the inboard upper portion 121 (and in an outboard upper portion 125) urges the cup 112 upwardly and slightly dorsally, keeping the cup 112 stable in the unfolded position.

In order to reduce any distortion that the inboard upper portion 121 causes on the band 115, the inboard upper portion 121 preferably attaches to the band 115 under one of the cups 112 (and therefore under one of the breasts 11 of the wearer 17, during use). For example, where the inboard upper portion 121 crosses the centerline CL once (as shown in FIG. 7), it connects to the band 115 at a point under the opposite breast 11 to the one that the cup 112 is intended to cover. In other words, the inboard upper portion 121 for the cup 112*a* may connect to the band 115 beneath the breast 11*b* of the wearer, and vice versa. Alternatively, where the inboard upper portion 121 crosses the centerline CL twice (i.e. where the inboard upper portion 121 wraps around the opposing upper portion 121 by 180 degrees as shown in FIG. 9) the inboard upper portion 121 may connect to the band 115 under the breast 11 that is covered by the associated cup 112. In other words, the inboard upper portion 121 for the cup 112*a* may connect to the band 115 beneath the breast 11*a*, and the inboard upper portion 121 for the cup 112*b* may connect to the band 115 beneath the breast 11*b*.

By connecting the inboard upper portion 121 to the band 115 under one of the breasts 11 of the wearer 17, forces exerted by the inboard upper portion 121 on the band 115 when the cup 112 is folded down for nursing are less likely to distort the bra because the presence of the breast 11 resists localized lifting of the band 115 thereunder. The reduced distortion of the bra 100 means that the other cup 112 which covers the other breast 11 of the wearer 17 is less likely to be pulled out of its desired shape and is therefore more easily able to properly support the other breast. While it is advantageous for the inboard upper portion 121 to contact the band 115 under the breast 11 of the wearer 17, it is nonetheless contemplated that in some embodiments, the inboard upper portion 121 may contact the band 115 at a point that is between the breasts 11 of the wearer 17 while still crossing over the centerline CL of the bra 100. By contrast, in at least some bras of the prior art, the cups are connected together and as a result, one cup is distorted when the other cup is folded for nursing.

In some embodiments, a connection between the cups 112*a* and 112*b* may be provided below the inboard upper portions 121 of the respective cups 112 without causing undue distortion of a cup 112 when the other cup is folded down for nursing.

As shown in FIG. 7, in some embodiments each cup 112 has a lower edge 152 that includes a first lower edge portion 152*a* that is under one of the breasts 11 of the wearer 17 and which is connected to the band and a second lower edge portion 152*b* that passes between the breasts 11 of the wearer 17 (and is therefore not under one of the breasts 11) and which is unconnected to the band 115. By not connecting the cup 112 to the portions of the band 115 that are not immediately under one of the breasts 11, localized distortion of the band 115 is inhibited when the cup 112 is folded to its folded position. In the embodiment shown in FIG. 9, the cups 112 are also not connected to the band 115 in the region of the band 115 that is between the breasts 11 (i.e. that is not immediately beneath one of the breasts 11).

If the cups 112 were connected to band 115 without crossing the centerline CL and without connecting to each other, the cups 112 might not provide sufficient support for the breasts 11 of the wearer 17, particularly in situations where the wearer 17 is lying on her side. By configuring the cups 112 to cross over the centerline, such as is shown in the embodiments in FIGS. 7 and 9, the cups 112 can support the breasts 11 of the wearer 17 even when the wearer 17 is lying on her side.

While the embodiment shown in FIGS. 7-11 does not show an underwire under the cups 112, it is optionally possible to provide one.

Those skilled in the art will understand that a variety of modifications may be effected to the above described embodiments without departing from the scope of the appended claims.

What is claimed is:

1. A bra, comprising:

a pair of cups that are self-supporting, each cup having an inboard end and an outboard end, wherein the inboard ends of the cups generally face each other and are connected together;

a shoulder strap connected to each cup, each shoulder strap having a primary strap portion that is configured to extend over a shoulder of a wearer and downwards towards an end that is associated with one of the cups; and a band extending from the cups and configured to extend around the back of the wearer, wherein, when the bra is worn by the wearer and when the wearer is upright, each cup is foldable along a fold line that extends generally diagonally between an inboard end and an outboard end that is generally vertically aligned with the end of the primary strap portion associated with the cup between an unfolded position wherein the cup covers a nipple of the wearer and a folded position wherein a portion of the cup is folded over to expose the nipple of the wearer, wherein, when the bra is worn by the wearer, self-support of each cup permits each cup to generally retain an unfolded shape when in the unfolded position, and wherein each cup is stable in the folded position by tension in the shoulder strap pulling upwardly on the folded over portion of the cup.

2. A bra as claimed in claim 1, wherein the fold line extends along a path such that in the folded position, the cup exposes the areola of the wearer.

3. A bra as claimed in claim 1, wherein, when the bra is worn by the wearer and when the wearer is upright, the outboard end of the fold line is positioned higher than the inboard end of the fold line, dividing the cup into an upper, inboard cup portion, and a lower, outboard cup portion.

4. A bra as claimed in claim 3, wherein each shoulder strap includes an end portion which connects the end of the primary strap portion to one of the cups, wherein the end portion of the shoulder strap includes an inboard end portion that connects to the upper, inboard cup portion and an outboard end portion that connects to at least one element selected from the group of elements consisting of the lower, outboard cup portion and the band.

5. A bra as claimed in claim 4, wherein the end portion of the shoulder strap is a contiguous strip of material and wherein the primary strap portion is slidably connected to the end portion of the shoulder strap.

6. A bra as claimed in claim 4, wherein the inboard end portion of the shoulder strap is elastically stretchable and is positioned to exert a biasing force on the upper, inboard cup portion to hold the upper, inboard cup portion in an unfolded position relative to the lower, outboard cup portion when the cup is in the unfolded position by tension in the inboard end portion of the shoulder strap when the inboard end portion of the shoulder strap is stretched by the weight of the breast of the wearer acting on the cup when the bra is being worn by the wearer and to exert a biasing force on the upper, inboard cup portion to hold the upper, inboard cup portion in a folded position relative to the lower, outboard cup portion when the cup is in the folded position by tension in the inboard end portion of the shoulder strap when the inboard end portion of the shoulder strap is stretched by the weight of the breast of the wearer acting on the cup.

7. A bra as claimed in claim 3, wherein the outboard end of the fold line is less than about 1 inch outboard from the end of the primary strap portion when the cup is in the folded position.

8. A bra as claimed in claim 3, wherein the outboard end of the fold line is less than about 0.5 inches outboard from the end of the primary strap portion when the cup is in the folded position.

9. A bra as claimed in claim 4, wherein each cup has an apex, and the inboard end portion of the shoulder strap connects to the cup at a point that is outboard from the apex of the cup.

10. A bra as claimed in claim 5, wherein the end of the primary strap portion remains substantially stationary laterally during movement of the cup from the unfolded position to the folded position.

11. A bra as claimed in claim 1, further comprising a breast use indicator that is movable between a first position to indicate that the left breast of the wearer has been used for nursing and a second position to indicate that the right breast of the wearer has been used for nursing.

12. A bra, comprising:

a pair of cups that are not self-supporting;

a band including a front portion and a rear portion wherein the front portion supports the cups and the rear portion extends around the back of a wearer of the bra; and a shoulder strap connected to an inboard upper portion of each cup, wherein the inboard upper portion extends from the shoulder strap past a vertical centerline of the bra and connects to the front portion of the band, wherein the inboard upper portion of each cup is unconnected to the inboard upper portion of the other cup, wherein, when the bra is worn by the wearer, each cup is foldable between an unfolded position wherein the cup covers a nipple of the wearer and a folded position wherein a portion of the cup is folded over to expose the nipple of the wearer, wherein, when the bra is worn by the wearer each cup is stable in the unfolded position and is stable in the folded position by tension in the shoulder strap pulling upwardly on the folded over portion of the cup.

13. A bra as claimed in claim 12, wherein the inboard upper portion of each of the cups connects to the band on an opposite side of the centerline to where the inboard upper portion of each of the cups connects to the shoulder strap.

14. A bra as claimed in claim 13, wherein each cup has a lower edge that includes a first lower edge portion that is connected to the band and a second lower edge portion that crosses the centerline of the bra and is unconnected to the band.

15. A bra as claimed in claim 13, wherein the inboard upper portion of each of the cups connects to the band under one of the cups.

16. A bra as claimed in claim 12, wherein the inboard upper portion of each cup wraps approximately 180 degrees around the inboard upper portion of the other cup thereby crossing the centerline from one side of the centerline to the other side of the centerline and then crossing back over to the one side of the centerline to connect to the band on the same side of the centerline where said inboard upper portion of each cup connects to an associated one of the shoulder straps.

17. A bra as claimed in claim 16, wherein the inboard upper portion of each one of the cups connects to the band under one of said one of the cups.

18. A bra as claimed in claim 15, wherein the inboard upper portion includes an inboard edge member that is elastically stretchable.

19. A bra as claimed in claim 12, wherein the shoulder strap is elastically stretchable.

20. A bra, comprising:

a pair of cups that are self-supporting, each cup having an inboard end and an outboard end, wherein the inboard ends of the cups generally face each other and are connected together;

a shoulder strap connected to each cup, each shoulder strap having a primary strap portion that is configured to extend over a shoulder of a wearer and downwards towards an end that is associated with one of the cups; and a band extending from the cups and configured to extend around the back of the wearer, wherein, when the bra is worn by the wearer, each cup is foldable along a fold line that extends generally diagonally between an inboard end and an outboard end that is generally vertically aligned with the end of the primary strap portion associated with the cup between an unfolded position wherein the cup covers a nipple of the wearer and a folded position wherein a portion of the cup is folded over to expose the nipple of the wearer, wherein, when the bra is worn by the wearer, self-support of each cup permits each cup to generally retain an unfolded shape when in the unfolded position, and wherein each cup is stable in the folded position by tension in the shoulder strap pulling upwardly on the folded over portion of the cup, wherein, when the bra is worn by the wearer and when the wearer is upright, the outboard end of the fold line is positioned higher than the inboard end of the fold line, dividing the cup into an upper, inboard cup portion, and a lower, outboard cup portion, wherein each shoulder strap includes an end portion which connects the end of the primary strap portion to one of the cups, wherein the end portion of the shoulder strap includes an inboard end portion that connects to the upper, inboard cup portion and an outboard end portion that connects to at least one element selected from the group of elements consisting of the lower, outboard cup portion and the band, wherein the inboard end portion of the shoulder strap is positioned to exert a biasing force on the upper, inboard portion of the cup to hold the upper, inboard portion of the cup in an unfolded position relative to the lower, outboard portion when the cup is in the unfolded position by tension in the inboard end portion of the shoulder strap when the inboard end portion of the shoulder strap is tensioned by the weight of the breast of the wearer acting on the cup when the bra is being worn by the wearer and to exert a biasing force on the upper, inboard cup portion to hold the upper, inboard cup portion in a folded position relative to the lower, outboard cup portion when the cup is in the folded position by tension in the inboard end portion of the shoulder strap when the inboard end portion of the shoulder strap is stretched by the weight of the breast of the wearer acting on the cup.

* * * * *